US005839369A

United States Patent [19]

Chatterjee et al.

[11] Patent Number: 5,839,369

[45] **Date of Patent: *Nov. 24, 1998**

[54] METHOD OF CONTROLLED LASER IMAGING OF ZIRCONIA ALLOY CERAMIC LITHOGRAPHIC MEMBER TO PROVIDE LOCALIZED MELTING IN EXPOSED AREAS

[75] Inventors: Dilip K. Chatterjee; Syamal K. Ghosh, both of Rochester; Donald M. Korn, Penfield, all of N.Y.

[73] Assignee: Eastman Kodak Company, Rochester, N.Y.

[ * ] Notice: The term of this patent shall not extend beyond the expiration date of Pat. No. 5,743,188.

[21] Appl. No.: 843,522

[22] Filed: Apr. 18, 1997

[51] Int. Cl.[6] ..... B41C 1/10

[52] U.S. Cl. ..... 101/467; 101/478; 430/945

[58] Field of Search ..... 101/450.1, 451, 101/453, 454, 456, 458, 459, 463.1, 465–467, 478; 430/302, 945

[56] References Cited

U.S. PATENT DOCUMENTS

| | | | |
|---|---|---|---|
| 3,506,779 | 4/1970 | Brown et al. | 101/467 |
| 3,549,733 | 12/1970 | Caddell | 101/401.1 |
| 3,574,657 | 4/1971 | Burnett | 101/465 |
| 3,654,864 | 4/1972 | Ovshinsky | 101/467 |
| 3,793,033 | 2/1974 | Mukherjee | 101/456 |
| 3,832,948 | 9/1974 | Barker | 101/401.1 |
| 3,945,318 | 3/1976 | Landsman | 101/467 |
| 3,962,513 | 6/1976 | Eames | 101/463.1 |
| 3,964,389 | 6/1976 | Peterson | 101/467 |
| 4,034,183 | 7/1977 | Uhlig | 219/121.85 |
| 4,054,094 | 10/1977 | Caddell | 101/467 |
| 4,081,572 | 3/1978 | Pacansky | 101/467 |
| 4,334,006 | 6/1982 | Kitajima | 430/254 |
| 4,687,729 | 8/1987 | Cadwell et al. | 101/463.1 |
| 4,693,958 | 3/1987 | Schwartz | 430/302 |
| 4,703,024 | 10/1987 | Aronov | 501/103 |
| 4,718,340 | 1/1988 | Love, III | 101/467 |
| 4,731,317 | 3/1988 | Fromson | 430/159 |
| 4,769,310 | 9/1988 | Gugger et al. | 430/346 |
| 4,794,680 | 1/1989 | Meyerhoff et al. | 492/54 |
| 4,846,065 | 7/1989 | Mayrhofer et al. | 101/453 |
| 4,967,663 | 11/1990 | Metcalf | 101/348 |
| 5,045,697 | 9/1991 | Schneider | 347/224 |
| 5,238,778 | 8/1993 | Hirai | 101/467 |
| 5,272,120 | 12/1993 | Kosuda et al. | 501/105 |
| 5,290,332 | 3/1994 | Chatterjee et al. | 65/18.1 |
| 5,293,817 | 3/1994 | Nussel et al. | 101/453 |
| 5,317,970 | 6/1994 | Nussel et al. | 101/478 |
| 5,336,282 | 8/1994 | Ghosh et al. | 51/309 |
| 5,345,869 | 9/1994 | Treverton et al. | 101/454 |
| 5,353,705 | 10/1994 | Lewis | 101/453 |
| 5,358,913 | 10/1994 | Chatterjee et al. | 501/103 |
| 5,378,580 | 1/1995 | Leenders | 430/303 |
| 5,385,092 | 1/1995 | Lewis | 101/467 |
| 5,395,729 | 3/1995 | Reardon | 430/200 |
| 5,454,318 | 10/1995 | Hirt et al. | 101/453 |
| 5,543,269 | 8/1996 | Chatterjee et al. | 430/346 |
| 5,555,809 | 9/1996 | Hirt et al. | 101/451 |

FOREIGN PATENT DOCUMENTS

| | | |
|---|---|---|
| 0 001 068 | 3/1979 | European Pat. Off. . |
| 0 531 878 A1 | 3/1993 | European Pat. Off. . |
| 0 573 091 | 12/1993 | European Pat. Off. . |
| 693 371 | 1/1996 | European Pat. Off. . |
| 44 42 235 A1 | 6/1995 | Germany . |

*Primary Examiner*—Stephen R. Funk
*Attorney, Agent, or Firm*—J. Lanny Tucker

[57] ABSTRACT

Reusable lithographic printing members are prepared from a zirconia ceramic that is an alloy of $ZrO_2$ and a second oxide chosen from MgO, CaO, $Y_2O_3$, $Sc_2O_3$, a rare earth oxide or a combination of any of these. In use, a printing surface of the zirconia alloy ceramic is imagewise exposed to electromagnetic radiation such as from a laser under controlled conditions to provide localized "melting" of the zirconia in the exposed areas. Those areas are transformed from a hydrophilic to an oleophilic state or from an oleophilic to a hydrophilic state, thereby creating a lithographic printing surface which is hydrophilic in non-image areas and is oleophilic and thus capable of accepting printing ink in image areas. Such inked areas can then be used to transfer an image to a suitable substrate in lithographic printing. The printing members are directly laser-imageable as well as image erasable, and can include printing plates, printing cylinders, printing tapes and printing sleeves.

20 Claims, 2 Drawing Sheets

FIG. 1
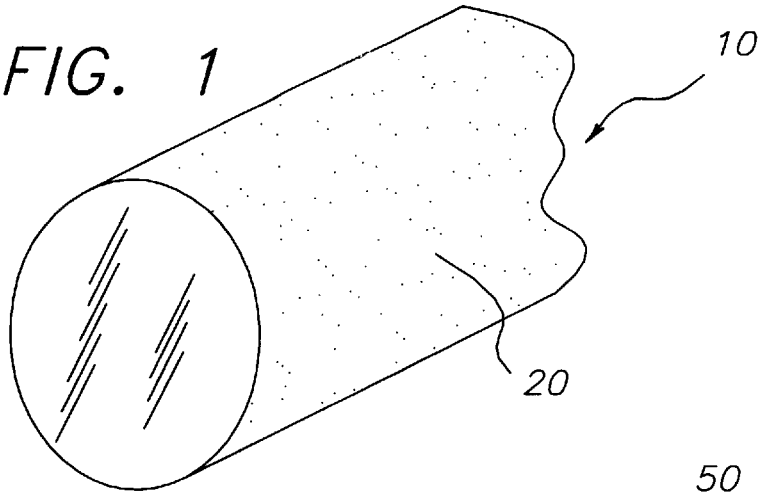
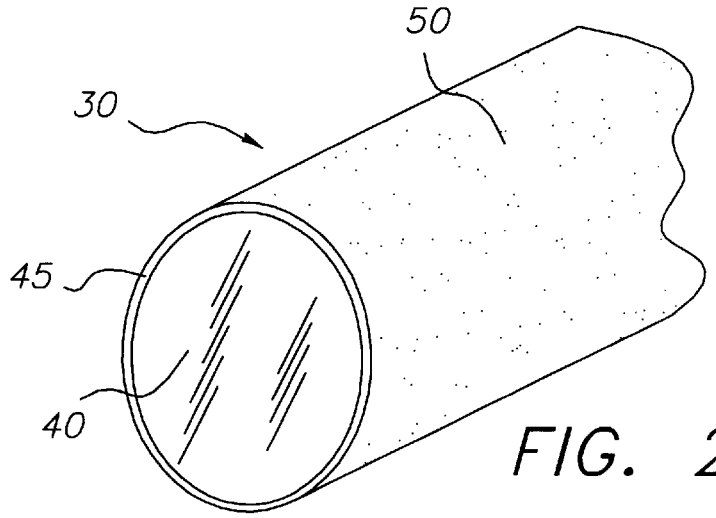
FIG. 2
FIG. 3
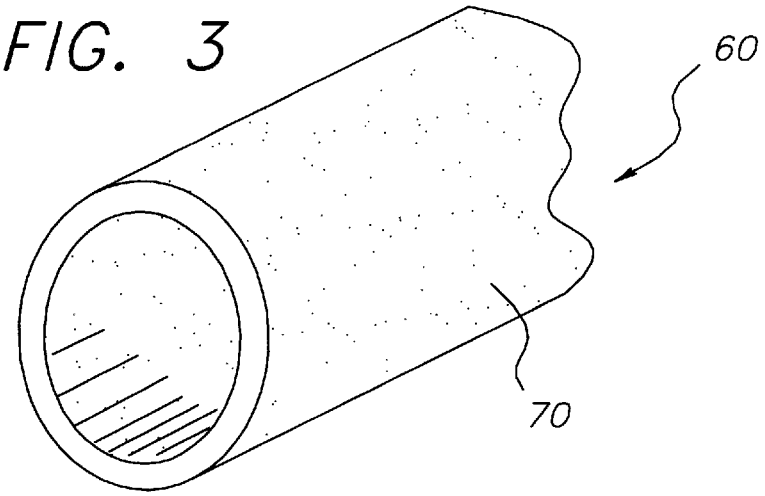

METHOD OF CONTROLLED LASER IMAGING OF ZIRCONIA ALLOY CERAMIC LITHOGRAPHIC MEMBER TO PROVIDE LOCALIZED MELTING IN EXPOSED AREAS

RELEVANT APPLICATIONS

Copending and commonly assigned U.S. Ser. No. 08/576,178, filed Dec. 21, 1995 by Ghosh et al, now U.S. Pat. No. 5,743,188 based on Provisional application 60/005,729, filed Oct. 20, 1995.

Copending and commonly assigned U.S. Ser. No. 08/844,348, filed on even date herewith by Chatterjee, Ghosh and N üssel, as a CIP of U.S. Ser. No. 08/576,178, noted above, and entitled "Zirconia Alloy Cylinders and Sleeves for Imaging and Lithographic Printing Methods".

Copending and commonly assigned U.S. Ser. No. 08/844,292, filed on even date herewith by Chatterjee and Ghosh, and entitled "Flexible Zirconia Alloy Ceramic Lithographic Printing Tape and Methods of Using Same."

FIELD OF THE INVENTION

This invention relates in general to lithography and in particular to new and improved methods of lithographic imaging and printing. More specifically, this invention relates to a method of imaging a zirconia alloy lithographic printing member using controlled laser imaging so that localized melting occurs in the image areas.

BACKGROUND OF THE INVENTION

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket, which in turn transfers the ink to the surface of the material upon which the image is to be reproduced.

Aluminum has been used for many years as a support for lithographic printing plates. In order to prepare the aluminum for such use, it is typical to subject it to both a graining process and a subsequent anodizing process. The graining process serves to improve the adhesion of the subsequently applied radiation-sensitive coating and to enhance the water-receptive characteristics of the background areas of the printing plate. The graining affects both the performance and the durability of the printing plate, and the quality of the graining is a critical factor determining the overall quality of the printing plate. A fine, uniform grain that is free of pits is essential to provide the highest quality performance.

Both mechanical and electrolytic graining processes are well known and widely used in the manufacture of lithographic printing plates. Optimum results are usually achieved through the use of electrolytic graining, which is also referred to in the art as electrochemical graining or electrochemical roughening, and there have been a great many different processes of electrolytic graining proposed for use in lithographic printing plate manufacturing. Processes of electrolytic graining are described in numerous references.

In the manufacture of lithographic printing plates, the graining process is typically followed by an anodizing process, utilizing an acid such as sulfuric or phosphoric acid, and the anodizing process is typically followed by a process which renders the surface hydrophilic such as a process of thermal silication or electrosilication. The anodization step serves to provide an anodic oxide layer and is preferably controlled to create a layer of at least 0.3 $g/m^2$. Processes for anodizing aluminum to form an anodic oxide coating and then hydrophilizing the anodized surface by techniques such as silication are very well known in the art, and need not be further described herein.

Illustrative of the many materials useful in forming hydrophilic barrier layers are polyvinyl phosphonic acid, polyacrylic acid, polyacrylamide, silicates, zirconates and titanates.

The result of subjecting aluminum to an anodization process is to form an oxide layer which is porous. Pore size can vary widely, depending on the conditions used in the anodization process, but is typically in the range of from about 0.1 to about 10 $\mu$m. The use of a hydrophilic barrier layer is optional but preferred. Whether or not a barrier layer is employed, the aluminum support is characterized by having a porous wear-resistant hydrophilic surface which specifically adapts it for use in lithographic printing, particularly in situations where long press runs are required.

A wide variety of radiation-sensitive materials suitable for forming images for use in the lithographic printing process are known. Any radiation-sensitive layer is suitable which, after exposure and any necessary developing and/or fixing, provides an area in imagewise distribution which can be used for printing.

Useful negative-working compositions include those containing diazo resins, photocrosslinkable polymers and photopolymerizable compositions. Useful positive-working compositions include aromatic diazooxide compounds such as benzoquinone diazides and naphthoquinone diazides.

Lithographic printing plates of the type described hereinabove are usually developed with a developing solution after being imagewise exposed. The developing solution, which is used to remove the non-image areas of the imaging layer and thereby reveal the underlying porous hydrophilic support, is typically an aqueous alkaline solution and frequently includes a substantial amount of organic solvent. The need to use and dispose of substantial quantities of alkaline developing solution has long been a matter of considerable concern in the printing art.

Efforts have been made for many years to manufacture a printing plate which does not require development with an alkaline developing solution. Examples of the many references relating to such prior efforts include, among others: U.S. Pat. No. 3,506,779 (Brown et al), U.S. Pat. No. 3,549,733 (Caddell), U.S. Pat. No. 3,574,657 (Burnett), U.S. Pat. No. 3,793,033 (Mukherjee), U.S. Pat. No. 3,832,948 (Barker), U.S. Pat. No. 3,945,318 (Landsman), U.S. Pat. No. 3,962,513 (Eames), U.S. Pat. No. 3,964,389 (Peterson), U.S. Pat. No. 4,034,183 (Uhlig), U.S. Pat. No. 4,054,094 (Caddell et al), U.S. Pat. No. 4,081,572 (Pacansky), U.S. Pat. No. 4,334,006 (Kitajima et al), U.S. Pat. No. 4,693,958 (Schwartz et al), U.S. Pat. No. 4,731,317 (Fromson et al), U.S. Pat. No. 5,238,778 (Hirai et al), U.S. Pat. No. 5,353,705 (Lewis et al), U.S. Pat. No. 5,385,092 (Lewis et al), U.S. Pat. No. 5,395,729 (Reardon et al), EP-A-0 001 068, and EP-A-0 573 091.

Lithographic printing plates designed to eliminate the need for a developing solution which have been proposed heretofore have suffered from one or more disadvantages which have limited their usefulness. For example, they have lacked a sufficient degree of discrimination between oleophilic image areas and hydrophilic non-image areas with the result that image quality on printing is poor, or they have had oleophilic image areas which are not sufficiently durable to permit long printing runs, or they have had hydrophilic non-image areas that are easily scratched and worn, or they have been unduly complex and costly by virtue of the need to coat multiple layers on the support.

The lithographic printing plates described hereinabove are printing plates which are employed in a process which employs both a printing ink and an aqueous fountain solution. Also well known in the lithographic printing art are so-called "waterless" printing plates which do not require the use of a fountain solution. Such plates have a lithographic printing surface comprised of oleophilic (ink-accepting) image areas and oleophobic (ink-repellent) background areas. They are typically comprised of a support, such as aluminum, a photosensitive layer which overlies the support, and an oleophobic silicone rubber layer which overlies the photosensitive layer, and are subjected to the steps of imagewise exposure followed by development to form the lithographic printing surface. Such printing plates can be directly imaged using lasers. In such instances, laser imaging typically "ablates" or partially or totally removes or loosens one or more layers in the exposed areas.

While such materials and imaging methods have considerable utility, there remains a need to remove or dispose of the "ablated" debris (that is, ablated or loosened debris from the layers) from the printing plates before inking. This can be done by wiping or washing with a solvent, or other mechanical means, as described for example in U.S. Pat. No. 5,378,580 (Leenders). This step, while essential in conventional methods, complicates the imaging and printing process, requiring an additional process step and additional equipment and/or cleaning solutions. Hence, there is a desire to avoid the need for removing debris from the imaging process.

There are some "erasable" plates known in the art that can be reused, but they have not gained high acceptance for a number of reasons. It would be desirable to have a means for printing multiple and varied images on the same lithographic printing member without the need for debris removal.

SUMMARY OF THE INVENTION

In accordance with this invention, the problems noted above are overcome with a method of imaging comprising the steps of:

A) providing a lithographic printing member having a printing surface composed of a zirconia ceramic that is an alloy of $ZrO_2$ and a secondary oxide selected from the group consisting of MgO, CaO, $Y_2O_3$, $Sc_2O_3$, a rare earth oxide, and combinations thereof, the zirconia alloy ceramic having a density of from about 5.6 to about 6.2 g/cm$^3$, and B) providing an image on the printing surface by imagewise exposing the printing surface to electromagnetic radiation provided by a laser under the following conditions:

an average power level of from about 0.1 to about 50 watts, a peak power of from about 6,000 to about 100,000 watts (in Q-switched mode), a pulse rate up to 50 kHz, and an average pulse width of from about 50 to about 500 $\mu$sec, so as to melt the zirconia in the exposed areas of the printing surface and to transform the printing surface from a hydrophilic to an oleophilic state or from an oleophilic to a hydrophilic state in the exposed areas of the printing surface, thereby creating a lithographic printing surface having both image areas and non-image areas.

This invention also provides a method of lithographic printing comprising the steps of:

A) providing the zirconia alloy ceramic printing member described above,

B) providing an image on the printing member as described above,

C) contacting the lithographic printing surface with an aqueous fountain solution and a lithographic printing ink, thereby forming an inked lithographic printing surface, and D) contacting the inked lithographic printing surface with a substrate to thereby transfer the printing ink to the substrate, forming an image thereon.

Such methods can additionally be continued by cleaning the ink off the printing surface, erasing the image thereon either by applying heat or by exposing it to suitable electromagnetic radiation, and reimaging the printing member, as described in more detail below. In such fashion, the invention can be used to provide a reusable lithographic printing member.

The printing members useful in this invention have a number of advantages. For example, no chemical processing is required so that the effort, expense and environmental concerns associated with the use of aqueous alkaline developing solutions are avoided. Post-exposure baking or blanket exposure to ultraviolet or visible light sources, as are commonly employed with many lithographic printing plates, are not required. Imagewise exposure of the printing member can be carried out directly with a focused laser beam which converts the ceramic surface from a hydrophilic to an oleophilic state or from an oleophilic to a hydrophilic state. Exposure with a laser beam enables the printing member to be prepared directly from digital data without the need for intermediate films and conventional time-consuming optical printing methods. Since no chemical processing, wiping, brushing, baking or treatment of any kind is required, it is feasible to expose the printing member directly on the printing press by equipping the press with a laser exposing device and suitable means for controlling the position of the laser exposing device. A still further advantage is that the printing member is well adapted to function with conventional fountain solutions and conventional lithographic printing inks so that no novel or costly chemical compositions are required. The printing members are also designed to be "erasable" as described below, that is the images can be erased and the printing members reused.

Imaging the printing members is carried out under controlled conditions of laser irradiation so that the exposed regions of the printing surface are "melted", not ablated, loosened or removed. Thus, the conditions of laser irradiation effectively melt the zirconia in the ceramic in those exposed areas because the irradiation produces sufficient heat to bring the temperature in those areas to above the melting point of zirconia (which is about 2700° C.). In this manner, the need to wipe, wash or otherwise remove debris resulting from imaging is avoided.

The zirconia alloy ceramic utilized in this invention has many characteristics which render it especially beneficial for use in lithographic printing. Thus, for example, the ceramic surface is extremely durable, abrasion-resistant, and long wearing. Lithographic printing members utilizing this surface are capable of producing a virtually unlimited number of copies, for example, press runs of up to several million. On the other hand, since very little effort is required to prepare the member for printing, it is also well suited for use in very short press runs for the same or different images. Discrimination between oleophilic image areas and hydrophilic non-image areas is excellent so that image quality on printing is unsurpassed. The printing member can be of several different forms (described below) and thus can be flexible, semi-rigid or rigid. Its use is fast and easy to carry out, image resolution is very high and imaging is especially well suited to images that are electronically captured and digitally stored.

A further particular advantage of lithographic printing members prepared from zirconia alloy ceramics as described herein is that, unlike conventional lithographic printing plates, they are erasable and reusable. Thus, for example, after the printing ink has been removed from the printing surface using known devices and procedures, the oleophilic image areas of the printing surface can be erased by thermally-activated oxidation or by laser-assisted oxidation. Accordingly, the printing member can be imaged, erased and re-imaged repeatedly.

The use of zirconia alloy ceramics as directly laser-imageable, erasable printing members in "direct-to-plate" applications has not been heretofore disclosed, and represents an important advance in the lithographic printing art.

BRIEF DESCRIPTION OF THE DRAWINGS

FIG. 1 is a highly schematic fragmentary isometric view of a printing cylinder useful in this invention, that is composed entirely of zirconia alloy ceramic.

FIG. 2 is a highly schematic fragmentary isometric view of a printing member that is composed of a non-ceramic core and a zirconia alloy ceramic layer or sleeve.

FIG. 3 is a highly schematic fragmentary isometric view of a hollow zirconia alloy ceramic printing sleeve of this invention.

DETAILED DESCRIPTION OF THE INVENTION

Figure 4:
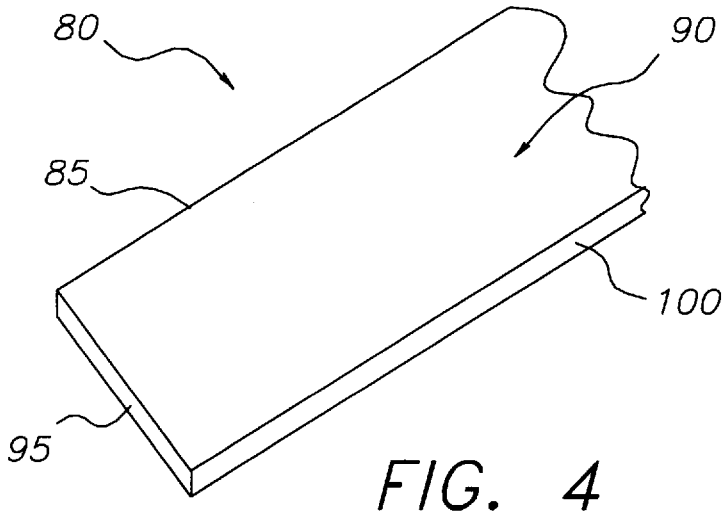
FIG. 4 is a highly schematic isometric partial view of a printing tape that is composed entirely of a web of a zirconia alloy ceramic.

A zirconia alloy ceramic of stoichiometric composition is hydrophilic. Transforming it from a stoichiometric composition to a substoichiometric composition changes it from hydrophilic to oleophilic. Thus, in one embodiment, the lithographic printing member comprises a hydrophilic zirconia alloy ceramic of stoichiometric composition, and imagewise exposure (usually with electromagnetic irradiation, preferably infrared irradiation) converts it to an oleophilic substoichiometric composition in the exposed regions (image areas), leaving non-exposed (background) areas hydrophilic.

In an alternative embodiment, the lithographic printing member comprises an oleophilic zirconia alloy ceramic of substoichiometric composition, and imagewise exposure (usually with electromagnetic irradiation, particularly either visible or infrared irradiation) converts it to a hydrophilic stoichiometric composition in the exposed regions. In this instance, the exposed regions serve as the background (or non-image areas) and the unexposed regions serve as the image areas.

The hydrophilic zirconia alloy ceramic is a stoichiometric oxide, $ZrO_2$, while the oleophilic zirconia alloy ceramic is a substoichiometric oxide, $ZrO_{2-x}$. The change from a stoichiometric to a substoichiometric composition is achieved by reduction while the change from a substoichiometric composition to a stoichiometric composition is achieved by oxidation.

In a preferred embodiment of the invention, the lithographic printing member is comprised of an alloy of zirconium oxide ($ZrO_2$) and a secondary oxide selected from the group consisting of MgO, CaO, $Y_2O_3$, $Sc_2O_3$, rare earth oxides (such as $Ce_2O_3$, $Nd_2O_3$ and $Pr_2O_3$), and combinations or mixtures of any of these secondary oxides. The secondary oxide can also be referred to as a dopant. The preferred dopant is $Y_2O_3$. Thus, a zirconia-yttria alloy ceramic is most preferred.

The molar ratio of secondary oxide (dopant) to zirconium oxide preferably ranges from about 0.1:99.9 to about 25:75, and is more preferably from about 0.5:99.5 to about 5:95 when the dopant is yttria. The dopant is especially beneficial in promoting the transformation of the high temperature stable phase of zirconia oxide (particularly, the tetragonal phase) to the metastable state at room temperature. It also provides improved properties such as, for example, high strength, and enhanced fracture toughness. The alloys described above have superior resistance to wear, abrasion and corrosion.

The zirconia alloy ceramic utilized in this invention can be effectively converted from a hydrophilic to an oleophilic state by exposure to infrared radiation at a wavelength of about 1064 nm (or 1.064 $\mu$m). Radiation of this wavelength serves to convert a stoichiometric oxide that is strongly hydrophilic, to a substoichiometric oxide that is strongly oleophilic by promoting a reduction reaction. The use for this purpose of Nd:YAG lasers that emit at 1064 nm is especially preferred.

Conversion from an oleophilic to a hydrophilic state can be effectively achieved by exposure to visible radiation with a wavelength of 488 nm (or 0.488 $\mu$m). Radiation of this wavelength serves to convert the substoichiometric oleophilic oxide to the stoichiometric hydrophilic oxide by promoting an oxidation reaction. Argon lasers that emit at 488 nm are especially preferred for this purpose, but carbon dioxide lasers irradiating in the infrared (such as 10600 nm or 10.6 $\mu$m) are also useful. In addition, heating the substoichiometric oxide at from about 150 to about 250° C. can also convert the oxide to a stoichiometric state.

The printing members useful in this invention can be of any useful form including, but not limited to, printing plates, printing cylinders, printing sleeves, and printing tapes (also in the form of printing webs).

Printing plates can be of any useful size and shape (for example, round, square or rectangular), and can be composed of the zirconia alloy ceramic throughout (monolithic), or have a ceramic layer disposed on a suitable metal or polymeric substrate (with one or more optional intermediate layers). Such printing plates can be prepared using known methods including molding zirconia alloy powders into the desired shape (for example, isostatic, dry pressing or injection molding) and then sintering at suitable high temperatures, such as from about 1200° to about 1600° C. for a suitable time (1 to 3 hours) in air or oxygen. Alternatively, they can be prepared by thermal spray coating or vapor deposition of a zirconia alloy on a suitable semi-rigid or rigid substrate.

Printing cylinders and sleeves are described, for example, in the noted CIP application, U.S. Ser. No. 08/844,348 of Chatterjee, Ghosh and Nüssel. These rotary printing members can be composed of the noted zirconia alloy ceramic throughout, or the printing cylinder or sleeve can have the ceramic only as an outer layer. Hollow or solid metal or alloy (non-ceramic) cores can be used as substrates if desired. Such printing members can be prepared, using methods described above for the printing plates, as monolithic members or fitted around a metal or alloy (non-ceramic) core.

With regard to printing plates, printing cylinders and printing sleeves, the zirconia alloy ceramic generally has very low porosity, that is less than about 0.1%, a density of from about 5.6 to about 6.2 g/cm$^3$ (preferably from about 6.03 to about 6.06 g/cm$^3$ for preferred zirconia-3 mol % yttria alloys), and a grain size of from about 0.1 to about 0.6 $\mu$m (preferably from bout 0.2 to about 0.5 $\mu$m). A useful thickness of the zirconia alloy ceramic would be readily apparent to one skilled in the art.

The zirconia alloy ceramics useful in preparing printing tapes have a little more porosity, that is generally up to about 2%, and preferably from about 0.2 to about 2%, to render them sufficiently flexible. The density of the material is generally from about 5.6 to about 6.2 g/cm$^3$, and preferably from about 6.03 to about 6.06 g/cm$^3$ (for the preferred zirconia-yttria alloy having 3 mol % yttria). Generally, they have a grain size of from about 0.1 to about 0.6 $\mu$m, and preferably from about 0.2 to about 0.5 $\mu$m.

The ceramic printing tapes have an average thickness of from about 0.5 to about 5 mm, and preferably from about 1 to about 3 mm. A thickness of about 2 mm provides optimum flexibility and strength. The printing tapes can be formed either on a rigid or semi-rigid substrate to form a composite with the ceramic providing a printing surface, or they can be in monolithic form.

The printing members useful in this invention can have a surface that is highly polished (as described below), or textured using any conventional texturing method (chemical or mechanical). In addition, glass beads can be incorporated into the ceramic surface to provide a slightly textured or "matted" printing surface.

The zirconia alloys referred to herein and methods for manufacturing zirconia ceramic articles having high densities (identified above) using very fine (0.1 to 0.6 mm grain size) zirconia alloy powders are described in U.S. Pat. No. 5,290,332 (Chatterjee et al), U.S. Pat. No. 5,336,282 (Ghosh et al) and US-A5,358,913 (Chatterjee et al), the disclosures of which are incorporated herein by reference. The resolution of laser written images on zirconia ceramic surfaces depends not only on the size of the laser spot and its interaction with the material, but on the density and grain size of the zirconia. The zirconia ceramics described in the noted patents are especially effective for use in lithographic printing because of their high density and fine grain size. The density and porosity of the ceramic printing members can also be varied by adjusting their consolidation parameters, such as pressure and sintering temperature.

Useful printing members can be produced by techniques described above, as well as (for printing tapes) thermal or plasma spray coating on a flexible substrate, by physical vapor deposition (PVD) or chemical vapor deposition (CVD) of zirconia or a zirconia alloy on a suitable semirigid or rigid substrate. In the case of PVD or CVD, the printing tapes can either be left on the substrate in the form of a composite, or they can be peeled off the substrate, or the substrate can be chemically dissolved away. Alternatively, the ceramic printing tapes can be formed by conventional methods such as slip casting, tape casting, dip coating and sol-gel techniques.

Thermal or plasma spray and CVD and PVD processes can be carried out either in air or in an oxygen environment to produce hydrophilic non-imaged printing surfaces. Whereas if these processes are carried out in an inert atmosphere, such as in argon or nitrogen, the printing surfaces thus produced are oleophilic in nature. The printing tapes prepared by other conventional methods require sintering of the "green" tapes at a suitable high temperature (such as 1200° to 1600° C.) for a suitable time (1 to 3 hours), in air, oxygen or an inert atmosphere.

The printing surface of the zirconia alloy ceramic can be thermally or mechanically polished, or it can be used in the "as sintered", "as coated", or "as sprayed" form, as described above. Preferably, the printing surface is polished to an average roughness of less than about 0.1 $\mu$m.

The zirconia utilized in this invention can be of any crystalline form or phase including the tetragonal, monoclinic and cubic crystalline forms, or mixtures of any two or more of such forms or phases. The predominantly tetragonal form of zirconia is preferred because of its high fracture toughness especially when yttria is the secondary oxide used in the alloy. By predominantly is meant, 100% of the zirconia is in the tetragonal crystalline form. Conversion of zirconia from one form to another is well known in the art.

In one embodiment of this invention, a printing member useful in this invention is a solid or monolithic printing cylinder composed partially or totally of the noted zirconia alloy ceramic. If partially composed of the ceramic, at least the outer printing surface is so composed. A representative example of such a printing cylinder is shown in FIG. 1. Solid rotary printing cylinder 10 is composed of a zirconia alloy ceramic throughout, and has outer printing surface 20.

Another embodiment, illustrated in FIG. 2, is rotary printing cylinder 30 having metal or alloy (non-ceramic) core 40 on which zirconia alloy ceramic layer or shell 45 has been disposed or coated in a suitable manner to provide outer printing surface 50 composed of the zirconia alloy ceramic. Alternatively, the zirconia alloy ceramic layer or shell 45 can be a hollow, cylindrical printing sleeve or jacket (see FIG. 3) that is fitted around metal or alloy (non-ceramic) core 40. The cores of such printing members are generally composed of one or more metals, such as ferrous metals (iron or steel), nickel, brass, copper or magnesium, and their alloys, or of non-metallic materials. Steel cores are preferred. The metal or alloy (non-ceramic) cores can be hollow or solid throughout, or be comprised of more than one type of metal, or alloys or non-metallic, inorganic or organic materials. The zirconia alloy ceramic layers disposed on the noted cores generally have a uniform thickness of from about 1 to about 10 mm.

Still another embodiment is shown in FIG. 3 wherein hollow cylindrical zirconia alloy ceramic sleeve 60 is composed entirely of the ceramic and has outer printing surface 70. Such sleeves can have a thickness within a wide range, but for most practical purposes, the thickness is from about 1 to about 10 cm.

FIG. 4 illustrates a printing tape useful in this invention in a partial isometric view. Tape 80 is an elongated web 85 of zirconia alloy ceramic that has printing surface 90, end 95 and edge 100 having a defined thickness (as described above). Such a web can be mounted on a suitable image setting machine or printing press, usually as supported by two or more rollers for use in imaging and/or printing.

Figure 5:
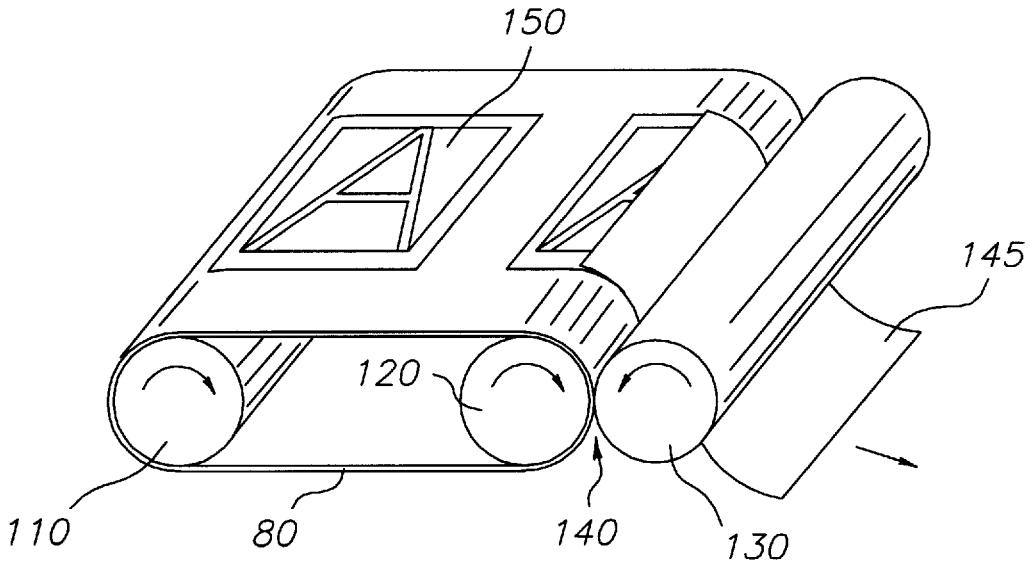
FIG. 5 is a highly schematic side view of a printing tape in a continuous web form, mounted on a set of rollers.

In a very simplified fashion, FIG. 5 schematically shows printing tape 80 supported by drive rollers 110 and 120. Drive roller 120 and backing roller 130 provide nip 140 through which paper sheet 145 or another printable substrate is passed after receiving the inked image 150 from tape 80. Such printing machines can also include laser imaging stations, inking stations, "erasing" stations, and other stations and components commonly used in lithographic printing.

The lithographic printing described herein can be imaged by any suitable technique on any suitable equipment, such as a plate setter or printing press. The essential requirement is imagewise exposure to radiation using a laser which is effective to convert the hydrophilic zirconia alloy ceramic to an oleophilic state or to convert the oleophilic zirconia alloy ceramic to a hydrophilic state using the irradiation conditions described above. Thus, the printing members can be imaged by exposure through a transparency or can be exposed from digital information such as by the use of a laser beam. Preferably, they are directly laser written. The laser, equipped with a suitable control system, can be used to "write the image" or to "write the background."

Zirconia alloy ceramics of stoichiometric composition are produced when sintering or thermal processing is carried out in air or an oxygen atmosphere. Zirconia alloy ceramics of substoichiometric composition can be produced when sintering or thermal processing is carried out in an inert or reducing atmosphere, or by exposing them to electromagnetic irradiation.

Although zirconia alloy ceramics of any crystalligraphic form or mixtures of forms can be used in this invention, the preferred zirconia alloy ceramic is an alloy of zirconium oxide ($ZrO_2$) and yttrium oxide ($Y_2O_3$) of stoichiometric composition. The preferred molar ratio of yttria to zirconia is from about 0.5:99.5 to about 5.0:95.0. Such alloys are off-white in color and strongly hydrophilic. The action of the laser beam transforms the off-white hydrophilic zirconia alloy ceramic to black substoichiometric zirconia alloy ceramic which is strongly oleophilic. The off-white and black compositions exhibit different surface energies, thus enabling one region to be hydrophilic and the other oleophilic. The imaging of the printing surface is due to photo-assisted thermal reduction while image erasure is either due to thermally-assisted reoxidation or to photo-assisted thermal reoxidation.

For imaging the zirconia alloy ceramic printing surface, it is preferred to utilize a high-intensity laser beam with a power density at the printing surface of from about $30\times10^6$ to about $850\times10^6$ watts/cm$^2$ and more preferably of from about $75\times10^6$ to about $425\times10^6$ watts/cm$^2$. However, any suitable exposure to electromagnetic radiation of an appropriate wavelength can be used in the practice of this invention.

An especially preferred laser for use in imaging the lithographic printing tape of this invention is an Nd:YAG laser that is Q-switched and optically pumped with a krypton arc lamp. The wavelength of such a laser is 1.064 $\mu$m.

For use in the hydrophilic to oleophilic conversion process, the following parameters are characteristic of a laser system that is especially useful to provide localized melting of the exposed areas.

Laser Power:

- Continuous wave average of 0.1 to 50 watts, preferably from 0.5 to 30 watts,
- Peak power (Q-switched) of from 6,000 to 100,000 watts, preferably of from 6,000 to 70,000 watts,
- Power density—$30\times10^6$ W/cm$^2$ to $850\times10^6$ W/cm$^2$, preferably from $75\times10^6$ to $425\times10^6$ W/cm$^2$, Spot size in $TEM_{00}$ mode=100 $\mu$m, Current=15 to 24 amperes, preferably from 18 to 24 amperes, Laser Energy=$6\times10^{-4}$ to $5.5\times10^{-3}$ J, preferably_from $6\times10^{-4}$ to $3\times10^{-3}$ J, Energy Density=5 to 65 J/cm$^2$, preferably from 7 to 40 J/cm$^2$, Pulse rate=0.5 to 50 kHz, preferably from 1 to 30 kHz, Pulse width=50 to 500 $\mu$sec, preferably from 80 to 300 $\mu$sec, Scan field=11.5×11.5 cm, Scan velocity=30 to 1000 mm/sec (maximum), and Repeatability in pulse to pulse jitter=~25% at high Q-switch rate (~30 kHz)<10% at low Q-switch rate (~1 kHz).

The laser images can be easily erased from the zirconia surface. The printing member is cleaned of printing ink in any suitable manner using known cleaning devices and procedures, and then the image is erased by either heating the surface in air or oxygen at an elevated temperature (temperatures of from about 150° to about 250° C. for a period of about 5 to about 60 minutes are generally suitable with a temperature of about 200° C. for a period of about 10 minutes being preferred) or by treating the printing surface with a $CO_2$ laser operating in accordance with the following parameters:

| | |
|---|---|
| Wave length: | 10.6 $\mu$m |
| Peak Power: | 300 watts (operated at 20% duty cycle) |
| Average Power: | 70 watts |
| Beam Size: | 500 $\mu$m with the beam width being pulse modulated. |

In addition to its use as a means for erasing the image, a $CO_2$ laser can be employed as a means of carrying out the imagewise exposure in the process employing an oleophilic to hydrophilic conversion. A tunable argon gas laser emitting at 0.488 $\mu$m can also be employed.

Only the printing surface of the zirconia alloy ceramic is altered in the image-forming process. However, the image formed is a permanent image which can only be removed by means such as the thermally-activated or laser-assisted oxidation described herein.

Upon completion of a printing run, the printing surface of the printing member can be cleaned of ink in any suitable manner and then the image can be erased and the printing member can be re-imaged and used again. This sequence of steps can be repeated again and again as the printing member is extremely durable and long wearing.

In the example provided below, the images were captured electronically with a digital flat bed scanner or a Kodak Photo CD. The captured images were converted to the appropriate dot density, in the range of from about 80 to about 250 dots/cm. These images were then reduced to two colors by dithering to half tones. A raster to vector conversion operation was then executed on the half-toned images. The converted vector files in the form of plot files were saved and were laser scanned onto the ceramic surface. The marking system accepts only vector coordinate instructions and these instructions are fed in the form of a plot file. The plot files are loaded directly into the scanner drive electronics. The electronically stored photographic images can be converted to a vector format using a number of commercially available software packages such as COREL DRIVE or ENVISION-IT by Envision Solutions Technology.

The invention is further illustrated by the following examples of its practice.

EXAMPLE 1:

A printing tape was prepared and imaged as follows: Zirconia alloy ceramic printing tapes were prepared by any one of the following thick or thin film forming processes, either on a flexible substrate or as a monolithic web. The tape forming processes include thermal or plasma spraying, physical vapor deposition (PVD), such as ion beam assisted sputtering, chemical vapor deposition (CVD), sol-gel film forming techniques, dip coating and slip casting. The noted methods and the appropriate choice of precursors are well known in the art. In certain experimental procedures, the tapes were formed as continuous webs.

In one instance, plasma spray/thermal spray methods were used, employing a PLASMADYNE SG-100 torch. Spraying was carried out on either 0.13 mm (5 mil) or 0.26 mm (10 mil) stainless steel substrates. The fine particle size distribution in the starting powder material exhibited considerable improvement in the sprayed printing tape density. Prior to spraying, the substrates were sand blasted to improve adhesion of sprayed zirconia alloy. Coating with the PLASMADYNE SG-100 torch produced uniform coating thickness throughout the length and width of the resulting printing tape. Further details of such procedures are provided in U.S. Pat. No. 5,075,537 (Hung et al) and U.S. Pat. No. 5,086,035 (Hung et al), incorporated herein by reference with respect to the zirconia ceramic layer preparations.

The resulting zirconia allow ceramic printing tapes were imaged using the procedure described in Example 2 below.

EXAMPLE 2:

Images containing half-tones through continuous tones were formed on several typical zirconia alloy ceramic printing tapes as described above. One surface of each printing tape was imaged by irradiation with a Nd:YAG laser emitting at 1.064 $\mu$m. Imaging was carried out on an off-white hydrophilic zirconia alloy surface. In this case, the imaged areas were oleophilic in nature.

In another embodiment, the entire printing surface was exposed to a Nd:YAG laser that turned the entire printing surface black (oleophilic) in color. This Nd:YAG laser was Q-switched and optically pumped with a krypton arc lamp. The spot size or beam diameter was approximately 100 $\mu$m in TEM (low order mode). The black oleophilic printing surface was then imaged at either 0.488 or 10.6 $\mu$m to provide exposed hydrophilic areas.

EXAMPLE 3:

Zirconia alloy ceramic printing plates were prepared in the form of 80 mm×60 mm×1 mm thick sintered zirconia/yttria ceramic sheets. The printing plates were imaged as described above in Example 2.

EXAMPLE 4:

A zirconia alloy printing cylinder or sleeve was prepared from highly dense zirconia alloy ceramics in any of the following forms: as a monolithic drum or printing cylinder, as a printing shell mounted on a metallic drum or core, or as a hollow printing sleeve. Each of these three forms were prepared using a zirconia-secondary oxide alloy, and specifically a zirconia-yttria alloy ceramic, using one of the following manufacturing processes:

a) dry pressing to the desired or near-desired shape, b) cold isostatic pressing and green machining, and c) injection molding and de-binding.

After each of these processes, the member was then subjected to high temperature (about 1500° C.) sintering and final machining to the desired dimensions.

The printing shell and sleeve were also prepared by slip casting of a zirconia alloy on a non-ceramic metallic core, and then sintering. The shells were assembled on metallic core either by shrink fitting or press fitting.

The printing cylinders were imaged as described above in Example 2.

EXAMPLE 5:

A zirconia alloy printing tape was prepared using plasma spray/thermal spray methods, employing a PLASMADYNE SG-100 torch. Spraying was carried out on either 0.13 mm (5 mil) or 0.26 mm (10 mil) stainless steel substrates. The fine particle size distribution in the starting powder material exhibited considerable improvement in the sprayed printing tape density. Prior to spraying, the substrates were sand blasted to improve adhesion of sprayed zirconia alloy. Coating with the PLASMADYNE SG-100 torch produced uniform coating thickness throughout the length and width of the resulting printing tape.

In another embodiment, a physical vapor deposition (PVD) method, more specifically ion-beam assisted sputtering, was used to prepare zirconia alloy ceramic printing tapes. Further details of such PVD procedures are provided in U.S. Pat. No. 5,075,537 (Hung et al) and U.S. Pat. No. 5,086,035 (Hung et al), incorporated herein by reference with respect to the zirconia ceramic layer preparations.

The printing tape was imaged as described above in Example 2. It was then used for printing as follows:

The imaged printing tape was cleaned with a fountain solution made up from Mitsubishi SLM-OD fountain concentrate. The concentrate was diluted with distilled water and isopropyl alcohol. Excess fluid was wiped away using a lint-free cotton pad. An oil-based black printing ink, Itek Mega Offset Ink, was applied to the printing tape by means of a hand roller. The ink selectively adhered to the imaged areas only. The image was transferred by placing plain paper over the plate and applying pressure to the paper.

The printing tape was cleaned of printing ink, "erased" and reused. The imaged printing tape was cleaned as noted above. After cleaning off printing ink, the printing tape was exposed to high heat (about 220° C.) to erase the image. The printing tape was then reimaged, reinked and reused for printing as described above.

The invention has been described in detail, with particular reference to certain preferred embodiments thereof, but it should be understood that variations and modifications can be effected within the spirit and scope of the invention.

We claim:

1. A method of imaging comprising the steps of:

A) providing a lithographic printing member having a printing surface composed of a zirconia ceramic that is an alloy of $ZrO_2$ and a secondary oxide selected from the group consisting of MgO, CaO, $Y_2O_3$, $Sc_2O_3$, a rare earth oxide, and combinations thereof, said zirconia alloy ceramic having a density of from about 5.6 to about 6.2 g/cm$^3$, and B) providing an image on said printing surface by imagewise exposing said printing surface to electromagnetic radiation provided by a laser under the following conditions:

an average power level of from about 0.1 to about 50 watts, a peak power of from about 6,000 to about 100,000 watts, a pulse rate up to 50 kHz, and an average pulse width of from about 50 to about 500 $\mu$sec, so as to melt the zirconia in the exposed areas of said printing surface, and to transform said printing surface from a hydrophilic to an oleophilic state or from an oleophilic to a hydrophilic state in said exposed areas of said printing surface, thereby creating a lithographic printing surface having both image areas and non-image areas.

2. The method of claim 1 wherein the molar ratio of said secondary oxide to said zirconium oxide is from about 0.1:99.9 to about 25:75.

3. The method of claim 1 wherein said zirconia alloy ceramic comprises cubic, monoclinic or tetragonal forms of zirconia, or mixtures of two or more of said forms of zirconia.

4. The method of claim 1 wherein said zirconia alloy ceramic is a zirconia-yttria ceramic.

5. The method of claim 4 wherein the molar ratio of said secondary oxide to zirconia is from about 0.5:99.5 to about 5.0:95.0.

6. The method of claim 4 wherein said zirconia alloy ceramic comprises zirconia in the tetragonal crystalline form.

7. The method of claim 1 wherein said zirconia alloy ceramic has a density of 6.03 to 6.06 grams/$cm^3$ and a grain size of 0.1 to 0.6 mm.

8. The method of claim 1 wherein said printing surface has been thermally or mechanically polished.

9. The method of claim 1 wherein said printing member is a printing tape having a porosity of up to 2%.

10. The method of claim 1 wherein said printing member is a printing plate, printing cylinder or printing sleeve having a porosity of less than about 0.1%.

11. The method of claim 1 wherein said printing member is composed of a hydrophilic stoichiometric zirconia alloy ceramic, and said imagewise exposure of said printing surface provides oleophilic exposed image areas and hydrophilic non-exposed background areas.

12. The method of claim 1 wherein said printing member is composed of an oleophilic substoichiometric zirconia alloy ceramic, and said imagewise exposure of said printing surface provides oleophilic non-exposed background areas and hydrophilic exposed image areas.

13. The method of claim 1 wherein said laser imaging is carried out using a laser having a power density of from about $30\times10^6$ to about $850\times10^6$ watts/$cm^2$.

14. The method of claim 1 wherein said laser imaging is carried out under the following conditions:

an average power level of from about 0.5 to about 30 watts, a peak power of from about 6,000 to about 70,000 watts, a pulse rate up to 30 kHz, and an average pulse width of from about 80 to about 300 $\mu$sec.

15. A method of lithographic printing comprising the steps of:

A) providing a lithographic printing member having a printing surface composed of a zirconia ceramic that is an alloy of $ZrO_2$ and a secondary oxide selected from the group consisting of MgO, CaO, $Y_2O_3$, $Sc_2O_3$, a rare earth oxide, and combinations thereof, said zirconia alloy ceramic having a density of from about 5.6 to about 6.2 g/$cm^3$, and B) providing an image on said printing surface by imagewise exposing said printing surface to electromagnetic radiation provided by a laser under the following conditions:

an average power level of from about 0.1 to about 50 watts, a peak power of from about 6,000 to about 100,000 watts, a pulse rate up to 50 kHz, and an average pulse width of from about 50 to about 500 $\mu$sec, so as to melt the zirconia in the exposed areas of said printing surface, and to transform said printing surface from a hydrophilic to an oleophilic state or from an oleophilic to a hydrophilic state in said exposed areas of said printing surface, thereby creating a lithographic printing surface having both image areas and non-image areas, C) contacting said lithographic printing surface with an aqueous fountain solution and a lithographic printing ink, thereby forming an inked lithographic printing surface, and D) contacting said inked lithographic printing surface with a substrate to thereby transfer said printing ink to said substrate, forming an image thereon.

16. The method of claim 15 wherein imaging is carried out using a laser having a power density of from about $30\times10^6$ to about $850\times10^6$ watts/$cm^2$.

17. The method of claim 15 wherein laser imaging is carried out under the following conditions:

an average power level of from about 0.5 to about 30 watts, a peak power of from about 6,000 to about 70,000 watts, a pulse rate up to 30 kHz, and an average pulse width of from about 80 to about 300 $\mu$sec.

18. The method of claim 15 further comprising cleaning the ink off said printing surface, and erasing said image.

19. The method of claim 18 wherein said image is erased by: either heating said cleaned printing surface at from about 150° to about 250° C. for up to about 60 minutes, or exposing said cleaned printing surface to a carbon dioxide laser emitting at a wavelength of about 10.6 $\mu$m or to an argon laser emitting at a wavelength of about 0.488 $\mu$m.

20. A method for providing a reusable printing member comprising:

A) cleaning the ink off an imaged printing surface of a lithographic printing member having a printing surface composed of a zirconia ceramic that is an alloy of $ZrO_2$ and a secondary oxide selected from the group consisting of MgO, CaO, $Y_2O_3$, $Sc_2O_3$, a rare earth oxide, and a combination of any of these, said zirconia alloy ceramic having a density of from 5.6 to 6.2 g/$cm^3$, and B) erasing the image from said cleaned printing surface by either heating said cleaned printing surface at from about 150° to about 250° C. for up to about 60 minutes, or by exposing said cleaned printing surface to a carbon dioxide laser emitting at a wavelength of about 10.6 $\mu$m or to an argon laser emitting at a wavelength of about 0.488 $\mu$m.

* * * * *